US008096075B2

(12) United States Patent
Laney et al.

(10) Patent No.: US 8,096,075 B2
(45) Date of Patent: Jan. 17, 2012

(54) MUZZLELOADING RIFLE WITH BREECH PLUG HAVING GAS SEAL FACILITY

(75) Inventors: Mark C. Laney, Lee, NH (US); Gene L. Garland, New Durham, NH (US)

(73) Assignee: Thompson/Center Arms Company, Inc., Springfield, MA (US)

( * ) Notice: Subject to any disclaimer, the term of this patent is extended or adjusted under 35 U.S.C. 154(b) by 0 days.

(21) Appl. No.: 13/015,748

(22) Filed: Jan. 28, 2011

(65) Prior Publication Data

US 2011/0138669 A1 Jun. 16, 2011

Related U.S. Application Data

(62) Division of application No. 12/883,510, filed on Sep. 16, 2010, now Pat. No. 7,954,269, which is a division of application No. 11/334,002, filed on Jan. 17, 2006, now Pat. No. 7,814,694.

(51) Int. Cl.
*F41C 9/08* (2006.01)

(52) U.S. Cl. ..... 42/51; 89/26

(58) Field of Classification Search ..... 42/51; 89/26, 89/1.3

See application file for complete search history.

(56) References Cited

U.S. PATENT DOCUMENTS

| | | | | |
|---|---|---|---|---|
| 484,012 | A * | 10/1892 | Haskell | 89/26 |
| 2,473,555 | A * | 6/1949 | Weiss | 89/26 |
| 4,854,065 | A | 8/1989 | French et al. | |
| 5,305,679 | A * | 4/1994 | Begneu | 89/26 |
| 5,561,934 | A | 10/1996 | Knight | |
| 5,615,507 | A | 4/1997 | French | |
| 5,639,981 | A | 6/1997 | French | |
| 5,680,722 | A | 10/1997 | French et al. | |
| 5,737,863 | A * | 4/1998 | Rainey, III | 42/51 |
| 5,782,030 | A | 7/1998 | French | |
| 5,907,920 | A | 6/1999 | Laney | |
| 6,145,235 | A | 11/2000 | Emerson et al. | |
| 6,219,951 | B1 | 4/2001 | Cate | |
| 6,532,692 | B2 | 3/2003 | Cate | |
| 6,604,311 | B1 | 8/2003 | Laney et al. | |
| 6,834,455 | B2 | 12/2004 | Burigana | |
| 7,140,138 | B1 | 11/2006 | Laney et al. | |
| 7,257,917 | B1 | 8/2007 | Garland | |
| 7,353,631 | B2 | 4/2008 | Calvete Zumalde | |
| 7,621,064 | B2 | 11/2009 | Laney et al. | |
| 2006/0248771 | A1 | 11/2006 | Richards | |
| 2007/0028499 | A1 | 2/2007 | DeLeeuw | |
| 2007/0137084 | A1 | 6/2007 | Laney et al. | |
| 2007/0163162 | A1 | 7/2007 | Laney et al. | |

FOREIGN PATENT DOCUMENTS

EP 0178284 A1 4/1986

* cited by examiner

*Primary Examiner* — Stephen M Johnson
(74) *Attorney, Agent, or Firm* — McCormick, Paulding & Huber LLP

(57) ABSTRACT

A muzzleloading firearm has a barrel with a bore on a bore axis, and the barrel has a muzzle end and a breech end. A frame is connected to the barrel, and has a breech face. The frame moves between an open position in which the breech face is away from the breech end of the barrel, and a closed position in which the breech face abuts the breech end of the barrel. A breech plug is removably attached to the barrel. The breech plug including a seal element closely received by the bore. The seal element may be a set of piston rings that are received in a circumferential groove about a forward end of the plug, or may be a cup at the forward end, with a forward rim that flares under pressure to provide a gas seal.

16 Claims, 5 Drawing Sheets

MUZZLELOADING RIFLE WITH BREECH PLUG HAVING GAS SEAL FACILITY

CROSS REFERENCE TO RELATED APPLICATION

This application is a divisional application of U.S. Ser. No. 12/883,510, filed Sep. 16, 2010, now U.S. Pat. No. 7,954,269, which is a divisional of U.S. patent application Ser. No. 11/334,002, filed on Jan. 17, 2006, now U.S. Pat. No. 7,814, 694, issued Oct. 19, 2010, both entitled "MUZZLELOADING RIFLE WITH BREECH PLUG HAVING GAS SEAL FACILITY", and is hereby incorporated by reference in its entirety.

FIELD OF THE INVENTION

This invention relates to firearms, and more particularly, to muzzleloading firearms.

BACKGROUND AND SUMMARY OF THE INVENTION

Muzzleloading rifles have an essentially closed breech at the rear of the barrel, so that powder and bullets must be loaded at the muzzle or forward end of the barrel. A typical muzzleloading rifle has a barrel with a breech plug attached to occupy an enlarged rear bore portion of the barrel at the breech end. In some rifles, the breech plug is permanently attached. In others, the breech plug is removable to facilitate pass-through cleaning of the bore.

An existing removable breech plug employs a finely threaded body that screws into the rear of the barrel, with 10-15 turns to secure it in place. This provides safety against hang fires and facilitates removal for cleaning. However, the fouling associated with muzzleloading rifles can clog the threads as gases and particles are forced into the threads during firing, this can freeze up the plug, and require undesirability great torque to remove the plug, through the many rotations required.

The present invention overcomes the limitations of the prior art by providing a muzzleloading firearm. The firearm has a barrel with a bore on a bore axis, and the barrel has a muzzle end and a breech end. A frame is connected to the barrel, and has a breech face. The frame moves between an open position in which the breech face is away from the breech end of the barrel, and a closed position in which the breech face abuts the breech end of the barrel. A breech plug is removably attached to the barrel. The breech plug including a seal element closely received by the bore. The seal element may be a set of piston rings that are received in a circumferential groove about a forward end of the plug, or may be a cup at the forward end, with a forward rim that flares under pressure to provide a gas seal.

DETAILED DESCRIPTION OF A PREFERRED EMBODIMENT

Figure 1:
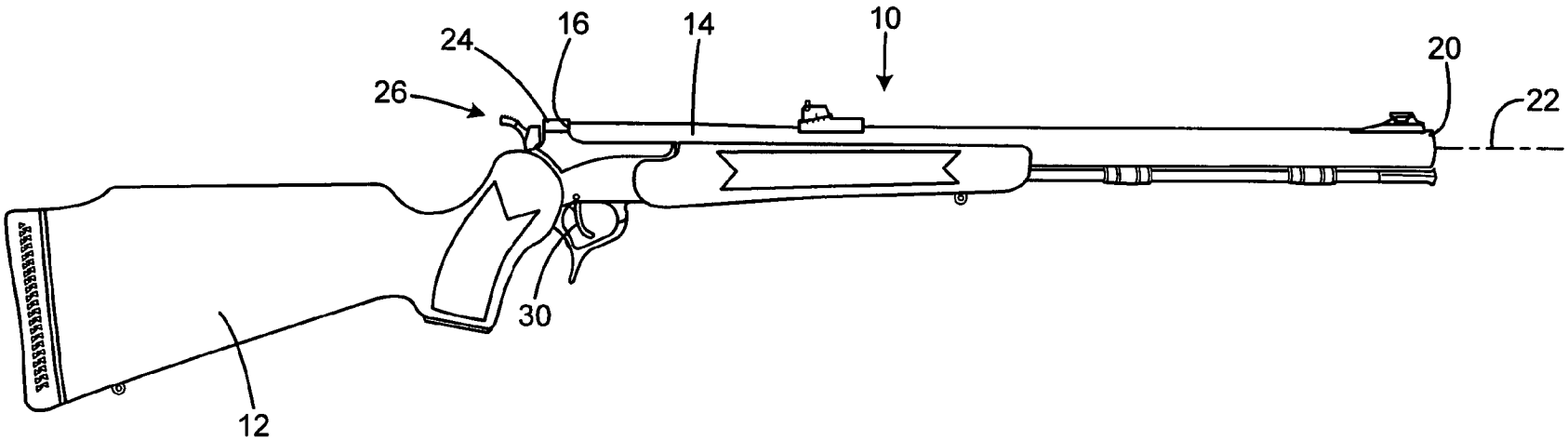
FIG. 1 is a side view of a firearm according to a preferred embodiment of the invention.

FIG. 1 shows a muzzleloading firearm 10, with stock 12 and a barrel 14 having a breech end 16 and a muzzle end 20, and having a bore defining a bore axis 22. A moveable breech element 24 pivots between an open position and a closed (shown) position. A hammer 26 is pivotally connected adjacent the breech block to operate in response to operation of a trigger 30 as will be discussed below. A muzzleloading firearm having some similar features is disclosed in U.S. Pat. No. 6,604,311 to Laney et al., the disclosure of which is incorporated herein by reference.

Figure 2:
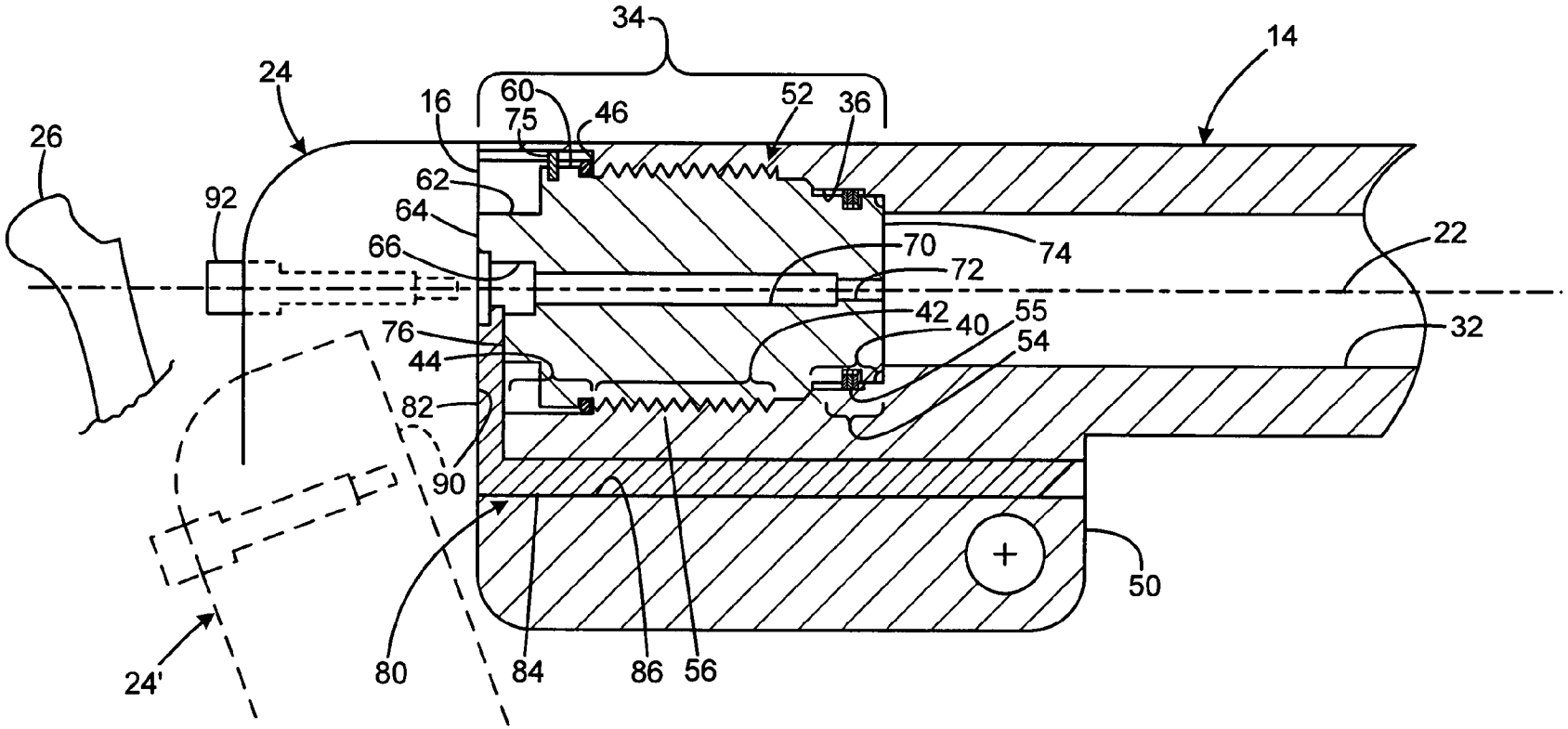
FIG. 2 is a sectional side view of the firearm of FIG. 1.

FIG. 2 shows the breech end 16 of the barrel 14. The barrel defines a rifled bore 32 (rifling not shown) that extends from the muzzle nearly the lengthy of the barrel, except for a rear portion 34. The rear portion of the barrel defines an enlarged breech plug chamber 36 having a stepped initial portion 40, an internally threaded intermediate portion 42, and an enlarged clearance portion 44. A shoulder 46 is formed at the rear end of the threaded portion where it meets the larger-diameter clearance portion 44. A lower lug 50 is integrally connected to a rear portion of the barrel.

The rear portion of the barrel is occupied by a breech plug 52. The breech plug is a generally cylindrical body with a nose portion 54 that is stepped to closely fit in the initial portion 40 of the breech plug chamber 36. Most of the length of the plug is provided with helical threads 56, or an alternative fastening element that provides extreme resistance to axial extraction forces, such as generated by firing a shot. The plug has a substantially circular flange 60 that is larger in diameter than the threaded portion, and which rests against the shoulder 46 when installed, as shown. The rear or breech end portion of the breech plug has an engageable section, which includes a hexagonal profile portion 62, in the shape of a bolt head that may be engaged by a socket wrench for removing and replacing the plug. A flat rear face 64 of the plug's hex portion is flush with the plane defined by the breech end of the barrel.

The nose portion 54 defines a circumferential groove that receives a set of three metal piston rings 55. The rings provide a tight seal against the sidewall of the breech plug chamber 36, so that threads will be protected against incursion of gas and debris. In an alternative embodiment, also discussed in detail below, a cup seal may be provided, the cup having an cylindrical sidewall extending to an open end in the forward direction and closely received in the chamber, so that the pressure generated by discharge tends to flare the cup, sealing against gases escaping rearwardly.

The breech plug defines a central bore having a primer pocket 66 at the breech end, a flash passage 70 from the primer pocket through most of the length of the plug, and a narrow passage 72 from the flash passage to the nose 74 or forward face of the plug. The primer pocket is generally cylindrical, to fit a standard primer for a muzzleloading rifle, with an enlarged diameter at the rearmost portion to closely accommodate the typical flanged primer. The breech plug includes a pin 75 that protrudes a short distance, radially from the periphery of the flange.

Figure 3:
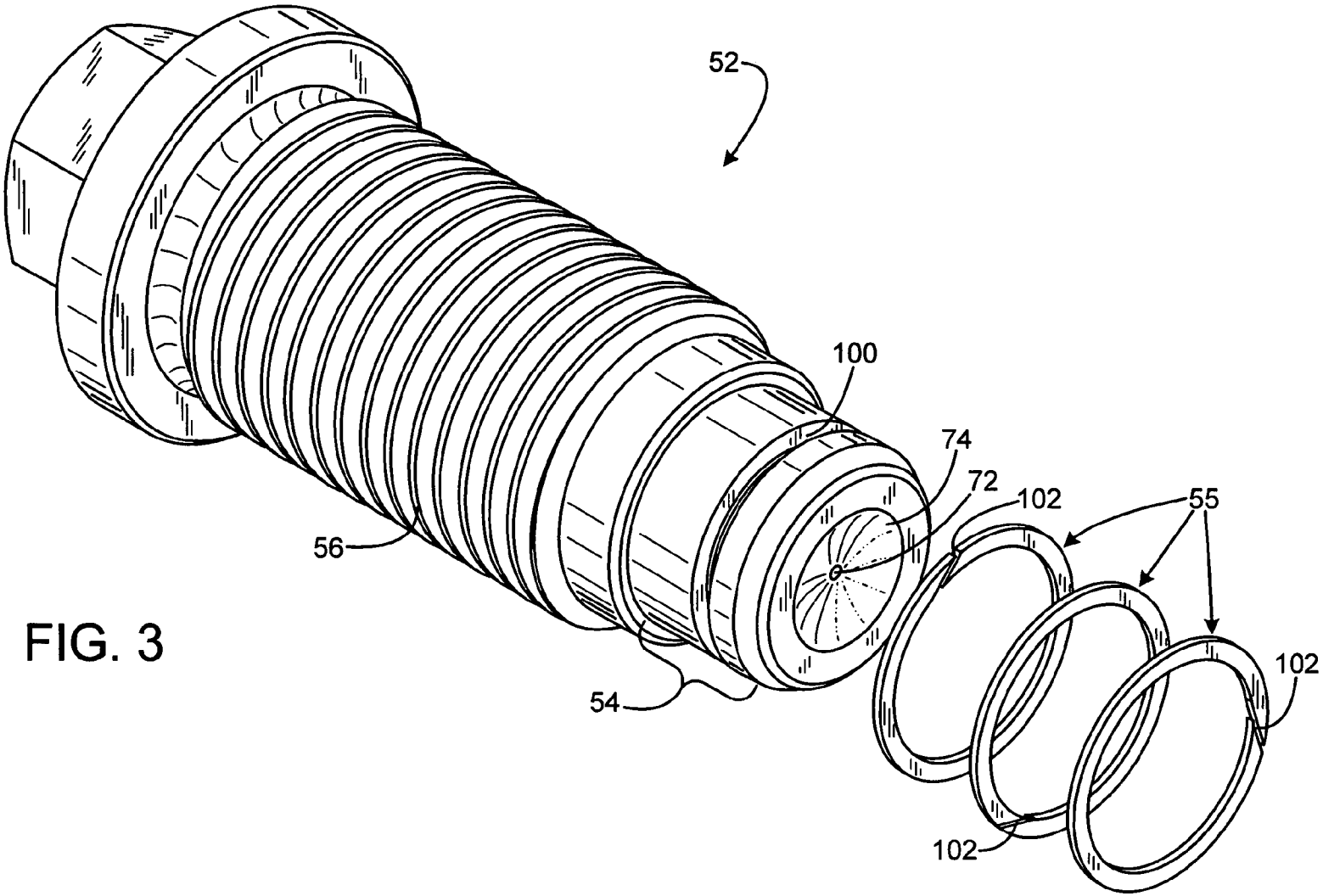
FIG. 3 is a perspective view of a breech plug of the firearm of FIG. 1.

As shown in FIG. 3, the breech plug further defines a rectangular slot 76 that extends downwardly, perpendicularly to the bore axis 22, from the center of the primer pocket. The pin protrudes in the opposite upward direction. The width of the slot is less than the diameter of the flange portion of the primer pocket, and about the same as the diameter of the main portion of the primer pocket. The depth of the slot (along a direction parallel to the barrel axis) is greater than the depth of the flange portion, but less than the depth of the primer pocket overall.

An extractor 80 is a solid body with an L-shaped form. It has a short leg 82 with a rectangular cross section that closely fits the slot 76, and a long leg 84 that has a cylindrical form, and which is closely received in a bore 86 in the lower lug that extends axially, parallel to the bore axis 22. The free end of the short leg of the extractor is formed with a curved lip that partly defines the primer pocket, with the same shape as the surface of revolution that defines the pocket. Thus, when the extractor is in the rest position shown, a primer in the pocket is closely received on all sides without substantial gaps, so that it is physically supported against rupture. Together, the rear face of the extractor leg 82 and the hex face 64 entirely encircle the primer pocket.

The extractor 80 is movable rearward to an extracted position, so that its lip draws a primer in the pocket partially from the pocket, in response to opening of the rifle action, by a linkage (not shown.) The extractor leg 82 inserts in the plug slot only when the plug is in one selected orientation, and prevents plug rotation while in that position. This aids against mis-installation of the plug, and the risk that a plug may work its way out of position during shooting. (or is not installed properly)

The breech element 24 is shown in the closed position in solid lines, and has a breech face 90 that abuts the barrel breech 16 and plug face 64 when closed. This provides a rear surface to fully enclose the primer pocket. A bore in the breech element along the bore axis 22 receives a firing pin 92 that is struck by the hammer 26 to fire the rifle, forcing a tip of the pin into a primer, which sends ignition gases through the plug bore, to ignite gun powder in the barrel. The breech element is shown in the open position (in which the extractor extends to eject the primer) in dashed lines 24'. The extractor is removable to allow removal of the breech plug.

Figure 4:
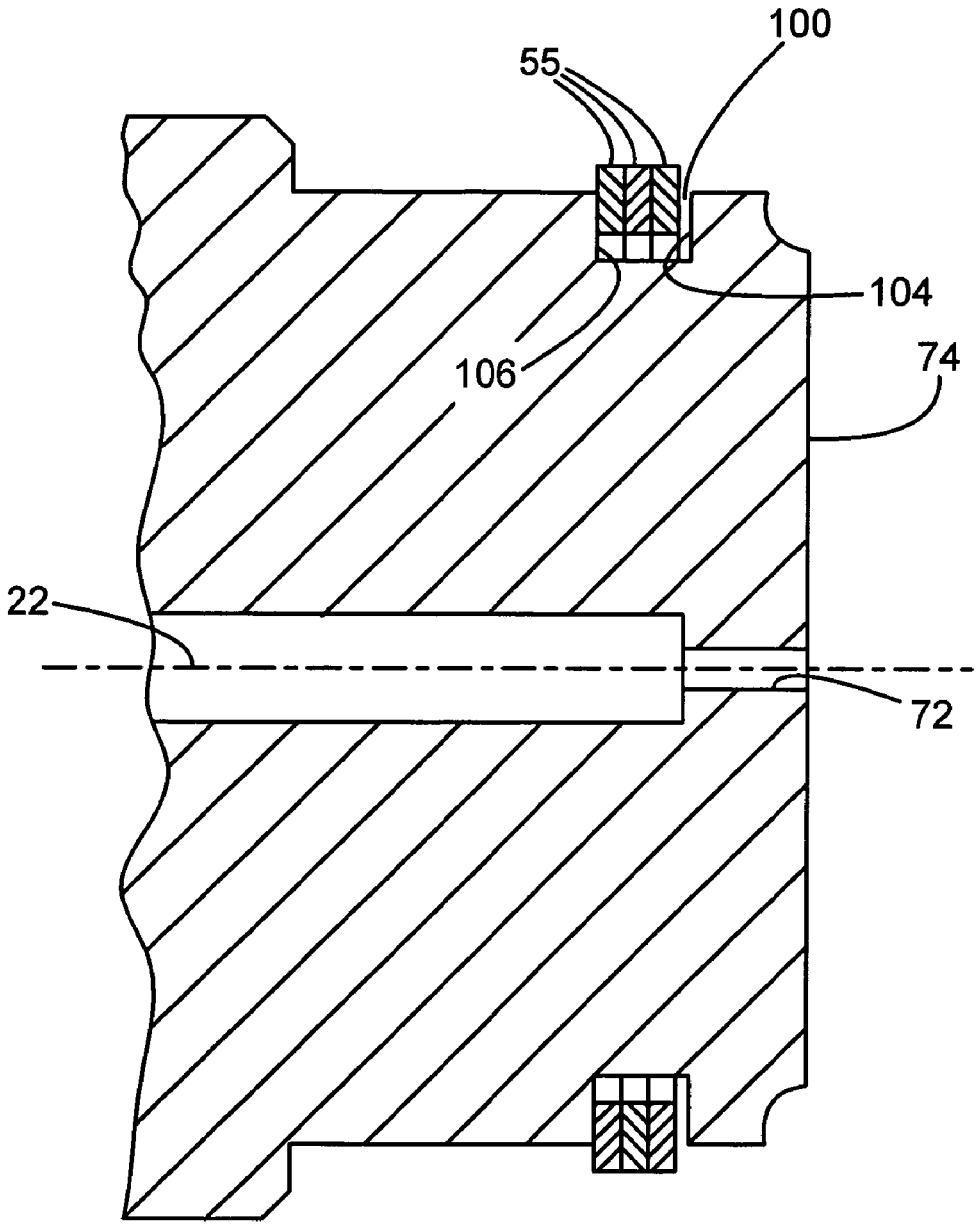
FIG. 4 is an enlarged sectional side view of a breech plug of the firearm of FIG. 1.

As shown in FIG. 3, the breech plug has a circumferential groove 100 at an intermediate axial position on the nose portion 54. The piston rings 55 are arranged with their gaps 102 offset from each other. FIG. 4 shows the rings 55 installed in the groove 100, which has flat front and rear faces 104, 106 that are parallel to each other and perpendicular to the plug axis 22. The groove has a width between the faces of 0.052 inch. The nose portion has a radius of 0.2625 inch, and the groove interior having a radius from the axis of 0.2125 inch. This provides that the groove has a depth of 0.050 inch. The barrel bore has a diameter of 0.531 inch. The rings 55 each have a thickness of 0.015 inch, an outside diameter of 0.531 inch, and an inside diameter of 0.450 inch. These ring dimension are applicable with the rings in a relaxed or untensioned state, in which their gaps 102 are essentially closed. However, to provide for accommodation of slight barrel bore variances, the rings may be provided with a slight gap for bore diameters on the large side, and this gap being closed for bores of minimum diameter.

Accordingly, the dimensions of the groove and rings provide that the stack of three rings is less than the groove width, and the interior of the rings fit loosely on the inner diameter of the groove. This avoids the rings being tensioned open, which would spread their gaps, and allow gases to pass. Also, the looseness allows any eccentricity of the plug thread axis with respect to the bore axis to be tolerated. Further, by the rings being able to shift axially between the rear face and forward face of the groove, the pressure of firing will cause them to abut the rear face, immediately providing a seal that has a strength proportionate to the gas pressure.

The loose rotatabilty of the ring stack with respect to the plug also provides that the rings are not providing excessive friction or suffering excess wear when the plug is screwed in or removed. If the rings were fixed to the plug, a point on the ring would follow a long helical path that corresponded to the total length of the thread. That length would be the circumference of the threaded portion times the number of turns. With the loose rings, the path traveled is less by one or two orders of magnitude, and is only the axial length of the threaded portion. Moreover, the effort of installation is reduced by this feature, because the advantage provided by the screw works to easily overcome the friction provided by the rings' snug fit in the bore.

In an alternative embodiment, the three separate split rings may be replaced by a single multi-turn closely wound helical coil. This is a McFarland-style seal employed in the gas pistons of military rifle actions. This avoids the possible blow-through of gasses via the ring gaps. Such a coil would require that at least the rear face be ground flat and square, so that it provides a seal under pressure against the rear shoulder of the plug groove in which it is received.

Figure 5:
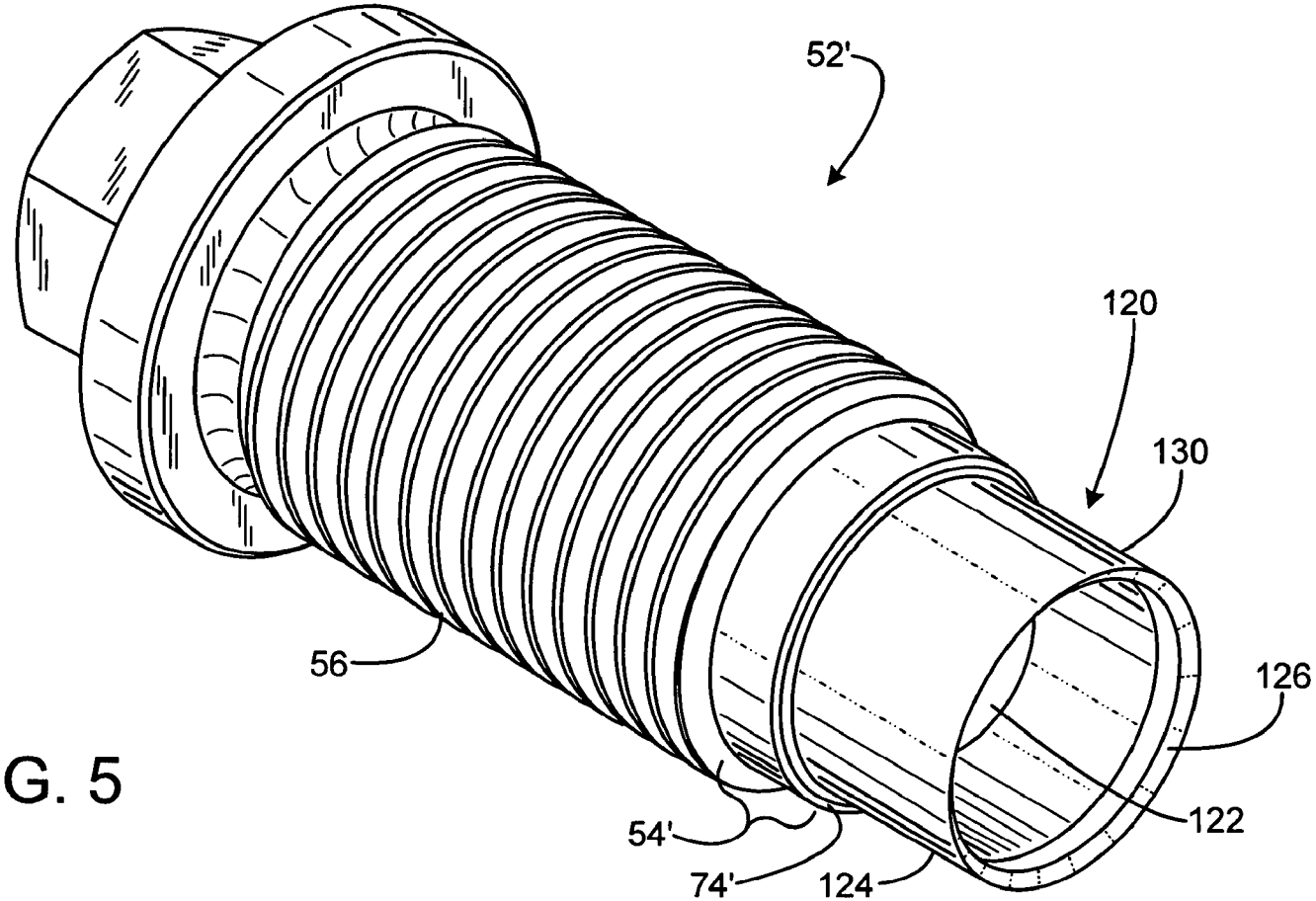
FIG. 5 is a perspective view of a breech plug according to an alternative embodiment of the invention.

FIG. 5 shows an alternative breech plug 52', which is identical to the above breech plug 52, except that is has a different gas seal means at its forward end. Plug 52' has a shorter nose portion 54' as formed in the integral steel plug. However, the plug has an attached cup element 120 attached to the forward face 74' of the plug 52'. The cup has a base 122 that is connected to the nose of the plug, and has a cylindrical side wall 124 that extends forward to a circular free edge 126 and has a substantially constant thickness. As also shown in FIG. 5, the cup element 120 is less than about a quarter of the overall length of the breech plug. The exterior surface 130 is cylindrical and closely fits within the bore of the barrel. The base has an aperture (not shown) to allow communication with the plug's flash hole, and the forward edge 126 is chamfered with a sharp edge, so that pressure from expanding gases tends to expand the cup, flaring it outward to provide a robust seal against gases that might otherwise escape reward toward the plug threads. Essentially, gas pressure within the cup serves to flare the cup outward, as does the pressure-reducing Bernoulli effect of any high-velocity gases in any initial small gap between the cup exterior 130 and the bore.

The cup is attached to the plug by a press friction fit. The breech plug has a boss turned on the forward end with an annular groove to accept a mating receptacle in the sealing cup.

In the preferred embodiment the cup is formed of a soft material such as brass, but it may be formed of any of a wide variety of materials that can withstand the heat and pressure of firing, and provide the flexibility for an effective seal. High temperature polymer composites such as those in the polyethylene family of plastics and PTFE and its variants are believed to be suitably robust and flexible. The use of either a cup or piston rings is intended for firearm barrels that lack rifling, or those with rifling that does not extend fully to the breech of the barrel.

While the above is discussed in terms of preferred and alternative embodiments, the invention is not intended to be so limited. For instance either seal type may be used in conjunction with alternative breech plug attachment methods, including multistart threads, interrupted threads, and rifle bolt concepts.

What is claimed is:

1. A breech plug for use in a muzzleloading firearm having a barrel with a muzzle end and a longitudinal bore extending rearward from the muzzle end to a rear barrel portion with a breech plug chamber having an initial portion having a tapered section, the rear barrel portion defining an aft facing surface, the breech plug comprising:

a cylindrical body having an external threading and defining a bore and a longitudinal axis therethrough;

a substantially circular flange being located rearward from the external threading and having an outer diameter being substantially larger than both the major diameter of the external threading and an inner diameter of the aft facing surface; and a cup element extending forward from the cylindrical body, the cup element having a base and a cylindrical side wall, the base being spaced longitudinally rearward from a forward end of the cylindrical side wall and forward of the external threading, the forward end of the cylindrical side wall being located at a distance from the substantially circular flange to allow the cylindrical side wall to act against the tapered section of the barrel to deform in a radial direction forward of the base when the substantially circular flange is positioned adjacent to the aft facing surface of the barrel.

2. The breech plug of claim 1, wherein the cup element being less than about a quarter of an overall length of the breech plug.

3. The breech plug of claim 1, wherein the base defines a recess connected with the bore of the cylindrical body, wherein the recess is configured to allow a flash to expand radially outward as the flash travels from the bore of the cylindrical body along the longitudinal axis.

4. The breech plug of claim 1, wherein the cylindrical side wall includes a chamfered forward edge.

5. The breech plug of claim 1, wherein the cylindrical side wall has a substantially constant thickness along the longitudinal length thereof.

6. The breech plug of claim 1, wherein the breech plug being a one-piece, integral body.

7. The breech plug of claim 1, wherein the breech plug being constructed of a same material as the barrel to which the breech plug is to be inserted.

8. The breech plug of claim 1, wherein the cylindrical side wall is elastically deformed by the cylindrical side wall acting against the tapered section.

9. The breech plug of claim 1, wherein the cylindrical side wall having an inner diameter being sized between the major diameter of the external threading and a diameter of the longitudinal bore of the barrel.

10. A breech plug for use in a muzzleloading firearm having a barrel with a longitudinal bore, the breech plug comprising:

a cylindrical body having a forward end and a rear end and defining a bore and a longitudinal axis therethrough, the cylindrical body having an overall length and an external threading along at least a portion of an outer circumference;

an engageable section extending rearward from the rear end of the cylindrical body, the engageable section having a circular flange being substantially larger in diameter than a major diameter of the external threading;

a cup element extending forward from the cylindrical body and having a relatively thin cylindrical wall and a base, the cylindrical wall extending forward from the forward end of the cylindrical body, the cup element defining an inner diameter and an outer diameter, the cylindrical wall forming a front, circular free edge and being less than one quarter of the overall length of the breech plug, the base of the cup element being located forward of the external threading of the cylindrical body, the inner diameter of the cup element being sized between the minor diameter of the external threading and a diameter of the longitudinal bore of the barrel.

11. The breech plug of claim 10, wherein the forward end of the cylindrical body defining a concave recess, the concave recess being in communication with the bore of the cylindrical body.

12. The breech plug of claim 10, wherein the cylindrical wall includes a chamfered forward edge.

13. The breech plug of claim 10, wherein the cylindrical wall being deformable in a radially direction.

14. The breech plug of claim 10, wherein the cylindrical wall defines a substantially constant thickness along the longitudinal length thereof.

15. The breech plug of claim 10, wherein the breech plug being a one-piece, integral body.

16. The breech plug of claim 10, wherein the breech plug being constructed of a same material as the barrel to which the breech plug is to be inserted.

* * * * *